United States Patent [19]

McClocklin et al.

[11] 4,083,381

[45] Apr. 11, 1978

[54] CONTROL VALVE

[75] Inventors: Samuel B. McClocklin; James C. Solie; Jan H. Boers, all of Owatonna, Minn.

[73] Assignee: Owatonna Tool Company, Owatonna, Minn.

[21] Appl. No.: 644,530

[22] Filed: Dec. 29, 1975

[51] Int. Cl.[2] ..... F15B 13/043

[52] U.S. Cl. ..... 137/596.15; 91/461; 137/596.16

[58] Field of Search ..... 91/461, 304, 446, 448, 91/464, 465; 137/596.14, 596.15, 596.16, 625.66, 625.27, 505–518, 101

[56] References Cited

U.S. PATENT DOCUMENTS

| | | | |
|---|---|---|---|
| 2,390,425 | 12/1945 | Crum | 91/464 X |
| 2,880,708 | 4/1959 | Hayner | 91/464 X |
| 3,016,917 | 1/1962 | Hunt | 137/625.27 |
| 3,129,645 | 4/1964 | Olmsted | 91/461 |
| 3,162,212 | 12/1964 | Leding | 137/596.15 X |
| 3,220,318 | 11/1965 | McGuire | 91/461 |
| 3,358,964 | 12/1967 | Cohen et al. | 137/505.18 X |
| 3,376,792 | 4/1968 | Clarke et al. | 137/505.18 X |
| 3,934,610 | 1/1976 | Solie | 137/596.16 X |

FOREIGN PATENT DOCUMENTS

| | | | |
|---|---|---|---|
| 984,180 | 2/1965 | United Kingdom | 137/625.27 |

*Primary Examiner*—Irwin C. Cohen

*Attorney, Agent, or Firm*—Wegner, Stellman, McCord, Wiles & Wood

[57] ABSTRACT

A control valve for controlling flow relative to a pair of control ports which includes a pair of 3-way valve components each having one of the control ports and a poppet valve member which, when closed in one position under pilot control, blocks pressure flow to a control port and connects the control port to reservoir, a pressure-reducing valve which initially operates to supply a relatively low pressure pilot fluid to a pilot control for the 3-way valves and, after operation of the latter, permit full line flow through a pair of branch passages each having a one-way check valve preventing return flow. Operation of the pilot control from a neutral position shifts one of a pair of pilot pistons associated one with each of the 3-way valves to move the poppet valve member of the associated 3-way valve to a position to close off the control port from line pressure and connect the same control port to reservoir and with line flow passing through a nonpiloted check valve to the other of said 3-way valves to the control port. The pilot control has a neutral control position wherein neither of the pilot pistons are actuated, with the result that each of the 3-way valves has its valve spool normally urged to a position closing off the pair of control ports from reservoir whereby, with the return flow blocked by a pair of non-piloted check valves, flow to and from said control ports is blocked and an operated device, such as a hydraulic cylinder, is locked in position.

6 Claims, 1 Drawing Figure

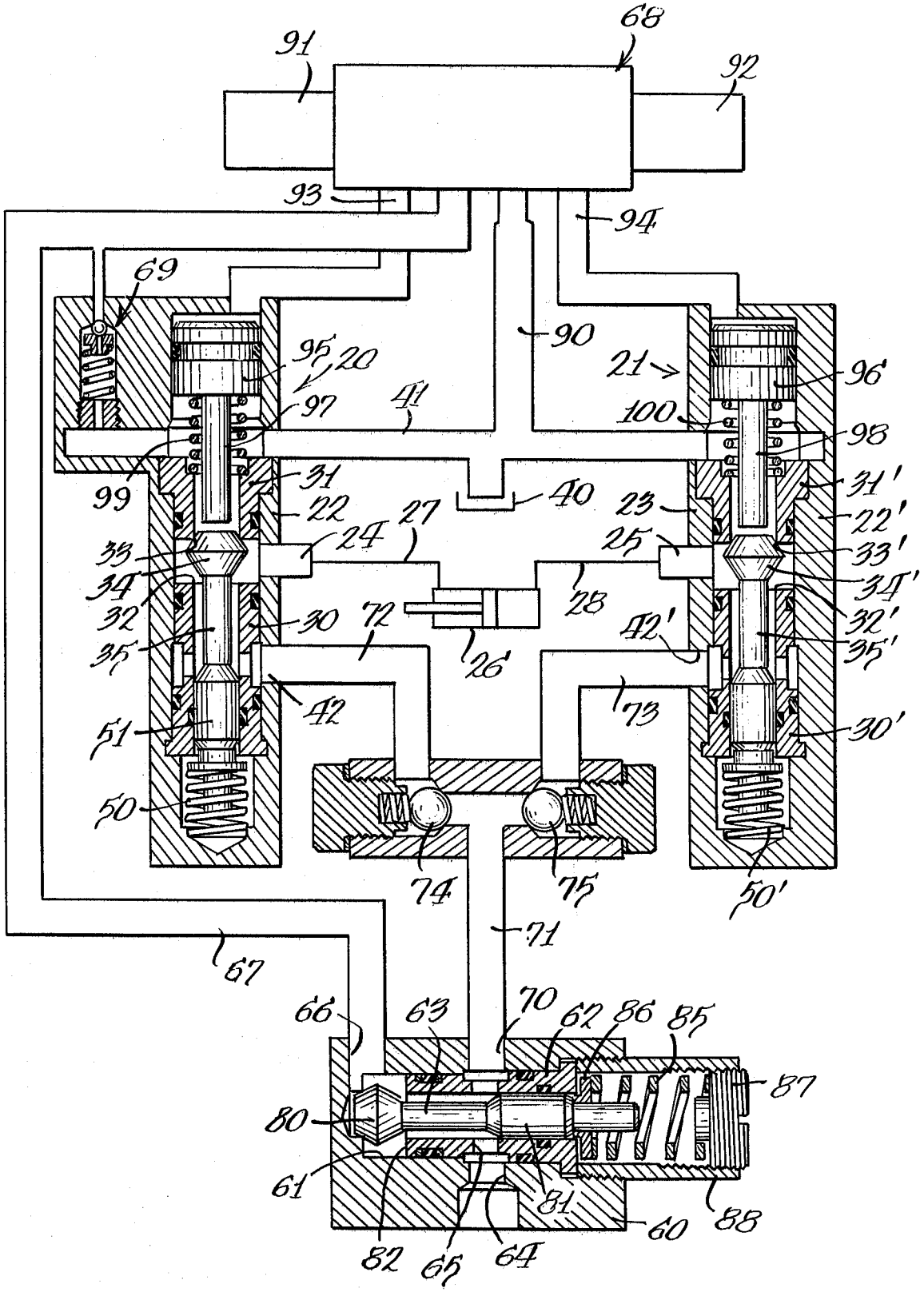
68
91
92
93
94
69
90
95
20
21
96
97
41
100
98
99
31
40
31'
22
27
23
22'
24
25
33'
33
34
34'
32
28
32'
30
72
42'
35
26
35'
42
73
51
30'
50
74
75
50'
71
67
66
63
70
62
86
85
87
80
61
81
88
60
82
65
64

CONTROL VALVE

BACKGROUND OF THE INVENTION

This invention pertains to control valves and, more particularly, to a pilot-operated, 4-way valve having flow to either of two control ports and also a neutral position wherein flow through said control ports is blocked in order to provide a hold position for an operated device, such as a hydraulic cylinder.

The assignee of this application has, for many years, manufactured a 4-way valve having a pair of 3-way valve components and with positioning thereof under the control of a solenoid-operated pilot valve. This valve did not have the capability of holding pressure on a pair of control ports connected to opposite ends of a double-acting cylinder in a neutral position. Such capability could be provided by the addition of a pair of pilot-operated check valves. Pilot-operated check valves are well known in the art. However, operation thereof requires additional passages for directing pilot fluid thereto for causing operation. In the control valve disclosed in this application, pressure can be held in the control ports by the particular construction of the 3-way valve components of the control valve, along with the use of conventional check valves, without providing for pilot operation thereof.

A component of the control valve disclosed herein is a pressure-reducing valve for establishing a relatively low pilot pressure and after pilot operation permitting full flow through the valve components with the pressure-reducing valve having a closed, balanced position. The assignee of this application developed a pressure-reducing valve with this capability several years ago, but such valve was not associated with the components of the control valve as disclosed herein to produce the operative device disclosed in this application.

For several years, there has been a solenoid-controlled, pilot-operated, 4-way valve on the market with a pair of control ports having their connection to a supply passage and to a reservoir controlled by two pairs of oppositely-acting check valves, with a pair of pilot pistons operable to open a passage between one control port and the reservoir and, at the same time, positively engage a valve element to close off flow from the supply passage to the same control port. This control valve additionally had a valve section for establishing a relatively low pilot pressure for pilot action followed by closing of the valve section to permit full line pressure delivery to a control port. This solenoid-controlled, pilot-operated, 4-way valve is constructed whereby pilot pressure acting on a pilot piston is in direct opposition to the line pressure delivered to a control port for operation of a cylinder whereby a relatively large valve for handling large volume and high pressures involves substantial forces in maintaining control positions. Additionally, the valve section for setting the pilot pressure is not balanced when closed and in opening must act against substantial resisting forces.

SUMMARY

A primary feature of the invention disclosed herein is in the structure of a control valve wherein the valve components operate to provide a relatively low pilot pressure and to thereafter deliver high pressure operating fluid to control ports without any significant variation in the required forces for shifting the valve components resulting from design variations in the volume or operating pressures of the fluid. This primary feature is obtained by use of 3-way valve components of the control valve, each having a valve spool which is balanced in a closed position as established by operation of a pilot piston of a pilot control to block fluid supply to the control port. Because of the balance, increases in the pressure of the fluid supply do not act against the positioning force on the valve spool which is exerted by the pilot piston. Additionally, the pressure-reducing valve, which establishes the relatively low pilot pressure and thereafter moves to a closed position, is balanced in said closed position whereby variations in main line pressure in the pressure-reducing valve do not upset the balance of forces or act in opposition to a spring force tending to open the valve when the pilot pressure goes below a value established by said spring.

An object of the invention is to provide a control valve and, more particularly, a pilot-operated 4-way valve for controlling flow relative to a pair of control ports and for establishing a neutral position in which flow through said control ports is blocked, with said control valve including a pair of 3-way valves, with each having a poppet valve member operable between a pair of valve seats to control the connection of a control port with either a reservoir or an inlet port and with the valve being balanced when closed against a valve seat to block communication between an inlet port and a control port; a pressure-reducing valve for establishing a relatively low pilot pressure and after pilot operation directing line flow through a passage with a pair of branch passages leading one to each of said 3-way valves and with a check valve in each of said branch passages preventing return flow to the pressure-reducing valve; and a pilot control for said pair of 3-way valves including a pair of pilot pistons associated one with each 3-way valve and under the control of a pilot control valve whereby application of pilot pressure to one of said pilot pistons causes movement thereof to shift a valve spool of a 3-way valve to a position wherein the communication between an inlet port and a control port is blocked whereby fluid passing through said passage flows to the other of said 3-way valves and through a check valve in a branch passage to flow to the control port associated with the latter 3-way valve. The pilot control valve has a neutral position wherein pilot fluid flows to reservoir whereby a spring associated with the valve spools of a 3-way valve holds the 3-way valve spool in a position to block communication of the control ports to the reservoir to provide a hold position.

Another object of the invention is to provide a valve as defined in the preceding paragraph wherein the valve spools of the 3-way valves include poppet valve members and with a pair of opposed valve seats between which said poppet valve member operates, with one valve seat between a control port and the reservoir connection and the other valve seat between the inlet port and the control port and with the first-mentioned valve seat having a slightly larger diameter than the other valve seat whereby when the poppet valve member is closed against said one valve seat of slightly larger diameter there is imbalance of forces resulting from pressure in the control port to assist the springs in holding the poppet valve members against said seats.

BRIEF DESCRIPTION OF THE DRAWING

The FIGURE is a schematic view of the solenoid-controlled, pilot-operated, 4-way valve shown connected to a double-acting cylinder and with the major valve components shown in section.

DESCRIPTION OF THE PREFERRED EMBODIMENT

The control valve has a pair of 3-way valves, indicated generally at 20 and 21, which are of the same construction and having body sections 22 and 23, respectively, with an internal bore and a control port 24 and 25, respectively, shown connected to opposite ends of a double-acting hydraulic cylinder 26 by a pair of lines 27 and 28. The construction of the 3-way valve 20 will be described in detail and with the corresponding structure of the 3-way valve 21 being given the same reference numeral with a prime affixed thereto. The valve has been shown schematically. However, it should be understood that all of the components would be in one or more contiguous body sections.

The 3-way valve 20 has a pair of sleeves 30 and 31 fitted in the bore thereof with the spaced-apart facing ends thereof defining first and second valve seats 32 and 33 positioned to either side of the control port 24 and for engagement by a poppet valve member 34 at the end of a valve spool 35. The valve seat 33 has a slightly larger diameter than the valve seat 32. The bore of the 3-way valve communicates through the interior of the sleeve 31 with a reservoir 40 by means of a passage 41. An inlet port 42 communicates through passages in the sleeve 30 with the interior of the valve and with the control port 24 being in communication therewith dependent upon the position of the poppet valve member 34.

The poppet valve member 34 has a pair of oppositely-extending, frusto-conical sections, with an upper section thereof seated, as shown, against the valve seat 33 of the sleeve 31 to block communication between the control port 24 and the reservoir passage 41. The valve spool is urged upwardly, as shown in the drawing, to maintain this condition by a spring 50 acting on the valve spool as well as pressure existing at the control port 24. This results from unbalanced areas being subject to this pressure. The valve spool 35 has a land 51 which is of the same diameter as the valve seat 32 whereby, with the valve spool as positioned as shown in the drawing, pressure at the control port 24 acts on a differential area resulting in an upward force because of the slightly larger diameter of the valve seat 33.

When the valve spool 35 is shifted downwardly, as viewed in the drawing, to close the poppet valve member 34 on the seat 32, there is then a balance of forces acting on the spool derived from pressure in the inlet port 42 and, at this time, the control port 24 is connected to the reservoir line 41, since the poppet valve member has moved away from the valve seat 33.

A casing section 60 of the control valve has a pressure-reducing valve with a bore 61 mounting a sleeve 62 in which a valve spool 63 is movable. A fluid supply port 64 communicates with the bore through sleeve passages 65 and is connectable to a pump or other source of fluid pressure providing fluid flow to the valve. A first outlet port 66 connects to a passage 67 for directing pilot fluid at a relatively low pressure to a pilot control and, more particularly, a pilot control valve indicated generally at 68. A relief valve, indicated generally at 69, is connected between the passage 67 and the reservoir passage 41 to prevent excessive pressure build-up in the passage 67, if pressure-reducing valve malfunctions. A second outlet port 70 of the pressure-reducing valve connects to a passage 71 having a pair of branch passages 72 and 73 extending to the inlet ports 42 and 42' of the 3-way valve components. The branch passages 72 and 73 each have a check valve 74 and 75, respectively, which are openable in response to pressure in the passage 71 to permit flow through the branch passages 72 and 73 to the inlet ports 42 and 42', but which act to prevent reverse flow.

The valve spool 63 of the pressure-reducing valve has a double frusto-conical end 80 with the right-hand side providing a poppet valve member and a balancing land 81 whereby, with the valve spool shifted toward the right from the position shown in the FIGURE, the poppet valve member closes against a valve seat 82 formed by an end of the sleeve 62 and the valve member is balanced in closed position because of the balancing land 81 which is the same diameter as the valve seat 82. The valve spool 63 is normally urged to the position shown by a spring 85 whereby fluid may flow from the fluid supply port 64 to the pilot fluid port 66. The spring 85 acts through a ring 86 engaging the valve spool and sets the maximum value of the pilot pressure. The spring force may be adjusted by adjustment of an end cap 87 threadably engaged within a spring housing member 88 which is exposed to the exterior of the control valve.

The pilot control includes a pilot control valve having a neutral position wherein the pilot fluid passage 67 communicates with a passage 90 extending to the reservoir passage 41 and a pair of piloting positions under the control of solenoids 91 and 92 wherein the pilot fluid delivered through passage 67 is directed to either of a pair of pilot lines 93 and 94. The pilot control further includes a pair of movable members in the form of pilot pistons 95 and 96 associated, one with each of the 3-way valve components 22 and 22' and with pilot lines 93 and 94. Each pilot piston has a stem 97 and 98, respectively, for selective engagement with a valve spool of a 3-way valve. The pilot pistons are urged to an inactive position by springs 99 and 100.

With the valve components positioned as shown in the drawing, the pilot control valve 68 is in neutral position as are the other valve components. Fluid delivered by a pump to the pressure-reducing valve flows through the passage 67 and through the pilot control valve to reservoir 40. Each of the 3-way valve components has its valve member positioned to block communication between the control ports 24 and 25 and the reservoir 40. The valve members are urged to this position by the springs 50 and 50' and also by an upward pressure force resulting from pressure in the operating cylinder 26 acting on the unbalanced areas of the valve spool. The check valves 74 and 75 are closed to hold this pressure.

Upon energization of solenoid 92, the pilot control valve is shifted to connect passage 67 to pilot passage 93 to direct pilot fluid to the pilot piston 95 and move it downwardly, as viewed in the drawing, to cause the stem 97 thereof to engage the valve spool and shift the valve spool against the action of the springs 50, 99 and the force from unbalanced areas. This moves the poppet valve member 34 away from the valve seat 33 to connect the control port 24 to reservoir 40 and engages the poppet valve member 34 against the valve seat 32. As pressure builds up in the pilot passage 67 to some value, as for example 500 p.s.i. as established by the force of the spring 85, the pressure force acting on the valve spool 63 exceeds the force of the spring 85 to move the poppet valve member 80 against the valve seat 82. At this time, there is a balanced condition whereby pressure may build up in the passage 71 leading to the 3-way valve components up to a value, for example, of 10,000 p.s.i., without requiring large forces to hold the pressure-reducing valve closed. The pressure in the passage 71 acts on the check valves 74 and 75. The check valve 75 will open with flow through the branch passage 73 to the 3-way valve component 22' and with the valve spool 35' thereof positioned, as shown in the drawing, there is flow through the control port 25 and through the line 28 to the cylinder 26. There is no flow through the check valve 74 since the valve spool 35 has been shifted to place the poppet valve member 34 against the valve seat 32 and block communication between the inlet port 42 and the control port 24. A balanced condition exists whereby a relatively low value pilot pressure acting on the pilot piston 95 can maintain the valve spool 35 in the shifted position regardless of operating pressure.

Upon deenergization of solenoid 92, the pilot control valve returns to neutral with release of pilot pressure from the pilot piston 95 whereby the springs 50 and 99 can act to return the valve spool 35 back to the position shown in the drawing to hold the cylinder 26 in position.

If the cylinder 26 is to be operated in the opposite direction, the solenoid 91 is energized to direct pilot pressure to the pilot piston 96 whereby the pilot piston moves stem 98 into engagement with the valve spool 35' to lower the valve spool to connect the control port 25 to reservoir 40 and close the poppet valve member 34' against the valve seat 32'. Fluid flows through the check valve 74 to the inlet port 42 of the 3-way valve component 22 and to the line 27 through the control port 24. After the cylinder 26 has been caused to move to the desired position, the pilot control valve 68 is returned to neutral position by deenergization of solenoid 91 to return both of the 3-way valve components to a hold position.

From the foregoing description, it will be noted that regardless of the pressure of the fluid acting on the hydraulic cylinder 26, only a relatively low pilot pressure is required to position the valve components and to maintain the valve components in particular positions. Specifically, when either of the valve members of the 3-way valve components are shifted by pilot pressure acting on a pilot piston against either of the valve seats 32 or 32' there is a balanced condition whereby a relatively high line pressure applied to an inlet port for the 3-way valve does not act in opposition to the force applied by the pilot pressure and pilot piston. Similarly, when the valve spool 63 of the pressure-reducing valve moves to closed position, there is a balanced condition with the valve being maintained closed only by the relatively low pilot pressure existing in the pilot passage port 66.

We claim:

1. A pilot-operated 4-way valve for controlling flow relative to a pair of control ports to provide a neutral hold position as well as advance and return operations including: a pair of 3-way valves each having an inlet port, one of said control ports, a port to reservoir, a bore and a valve spool movable therein, a pair of spaced-apart valve seats positioned one between said control port and reservoir port and the other between said control port and the inlet port with said one valve seat having a larger diameter than the other, and each of said valve spools having a poppet valve member engageable with one or the other of said last-mentioned seats and when said last-mentioned poppet valve member is closed against said other valve seat a section of said bore is open to the inlet port but blocked from the control port, and a land on said valve spool in said bore section subject to pressure in said bore section to provide a balance of fluid pressure forces whereby when the poppet valve member is closed against said other valve seat the closure is maintained regardless of the pressure in said bore section; a pressure-reducing valve for establishing a relative low pressure pilot fluid flow and after pilot operation permitting free flow therethrough and having a fluid supply port and first and second outlet ports with said first outlet port delivering pilot fluid, a valve spool with a poppet valve member for closing against a seat for blocking flow between said supply port and said first outlet port, a land on said last-mentioned valve spool providing for balance of said valve spool when said poppet valve member is closed, and a spring acting on said valve spool in a direction to maintain the last-mentioned poppet valve member away from said last-mentioned seat; a passage connected to said second outlet port of the pressure-reducing valve and with two branches thereof connected one to each of the inlet ports of the 3-way valves for delivery of fluid to the inlet ports of said 3-way valves; a pair of check valves positioned one in each of said branch passages and blocking return fluid flow from the 3-way valves to the pressure-reducing valve when the inlet port and a control port of the 3-way valves are in communication to establish the neutral hold position; and a pilot control for said pair of 3-way valves including, a pair of pilot pistons associated one with each 3-way valve, a pilot control valve having an inlet connected to the first outlet port of the pressure-reducing valve, an outlet port to reservoir and a pair of outlet ports flow connected one to each of said pilot pistons whereby actuation of a pilot piston shifts the associated 3-way valve spool to a position closed against said other valve seat to block said control port from the inlet port and with said balance of forces permitting the relative low pilot pressure acting on the pilot piston to hold said valve closed regardless of the pressure in said passage.

2. A valve as defined in claim 1 wherein said pilot control valve has a neutral position with flow from said inlet to reservoir and with the valve spools of the 3-way valves closed against said one seat thereof which, with said pair of check valves, blocks flow to and from said control ports.

3. A valve as defined in claim 2 wherein each 3-way valve has a spring acting on the valve spool thereof to urge said valve spool toward said one valve seat having the larger diameter whereby spring force plus the fluid pressure existing in the control port act to maintain the poppet valve member closed against said one valve seat when the associated pilot piston is inactive whereby fluid can not flow from the control port to reservoir.

4. A valve for controlling flow relative to a pair of control ports including; a pair of 3-way valves each having an inlet port, one of said control ports, a port to reservoir, a bore and a valve spool movable therein, a pair of spaced-apart first and second valve seats positioned with the first valve seat between said control port and reservoir port and the second valve seat between said control port and the inlet port, and each of said valve spools having a poppet valve member with opposed surfaces engageable with one or the other of said last-mentioned seats and when said last-mentioned poppet valve member is closed against said second valve seat a section of said bore is open to the inlet port but blocked from the control port, and a land on said valve spool in said bore section subject to pressure in said bore section to provide a balance of fluid pressure forces whereby when the poppet valve member is closed against said second valve seat the closure is maintained regardless of the pressure in said bore section; means defining a fluid supply passage with two branches thereof connected one to each of the inlet ports of the 3-way valves for delivery of fluid to the inlet ports of said 3-way valves; a pair of check valves positioned one in each of said branch passages and blocking return fluid flow from the control port of the associated 3-way valve when the poppet valve member of the last-mentioned valve is closed against said first valve seat to block communication between the reservoir port and the control port means acting on each valve spool for engaging the poppet valve member with the first valve seat; and a pair of movable members associated one with each 3-way valve for shifting the associated valve spool to a position closed against said second valve seat; said first valve seat being of a larger diameter than the second valve seat whereby when the poppet valve member engages said first valve seat there is a differential area on the valve spool subject to pressure at the control port urging the poppet valve member toward said first valve seat.

5. A valve as defined in claim 4 wherein said movable members are pilot pistons, and a pilot control valve operable to shift one or the other of said pilot pistons.

6. A valve as defined in claim 5 and means including a pressure-reducing valve having a spring connected in said fluid supply passage to provide a low pressure pilot fluid supply for said pilot control valve and after operation of a pilot piston permit full flow through said fluid supply passage.

* * * * *